US005473759A

United States Patent [19]

Slaney et al.

[11] Patent Number: 5,473,759

[45] Date of Patent: Dec. 5, 1995

[54] SOUND ANALYSIS AND RESYNTHESIS USING CORRELOGRAMS

[75] Inventors: Malcolm Slaney, Los Altos Hills; Richard F. Lyon, Los Altos; Daniel Naar, Hayward, all of Calif.

[73] Assignee: Apple Computer, Inc., Cupertino, Calif.

[21] Appl. No.: 20,785

[22] Filed: Feb. 22, 1993

[51] Int. Cl.[6] ..... G10L 5/10

[52] U.S. Cl. ..... 395/2.75; 395/2.67; 395/2.26; 395/2.72

[58] Field of Search ..... 395/2.25, 2.29, 395/2.46, 2.26, 2.67, 2.72, 2, 2.27, 2.78, 2.75

[56] References Cited

PUBLICATIONS

Classification of Whale and Ice Sounds with a cochlear Model Parks et al. IEEE/Mar. 1992.

A Comparison of DFT, PLP and Cochleagram for Alphabet Recognition Fanty et al. IEEE/Nov. 1991.

Speaker–Independent Vowel Recognition: Spectograms versus Cochleagrams Muthesamy et al. IEEE/Apr. 1990.

A Temporal Representation of Sound Slanley et al. John Wiley 1992.

Auditory Representations of Acoustic Signals Yang et al. IEEE/Mar. 1992.

Mellinger, David K., "Feature–Map Methods for Extracting Sound Frequency Modulation", *IEEE Computer Society Press,* 1991, pp. 795–799.

Hukin, R. W., "Testing an Auditory Model by Resynthesis", *European Conference on Speech Communication and Technology,* Sep. 26–29, 1989, pp. 243–246.

Yang, X., et al, "Auditory Representations of Acoustic Signals", *IEEE Transactions of Information Theory,* vol. 38, No. 2, Mar. 1992, pp. 824–839.

Lyon, R., "CCD Correlators for Auditory Models", *Proceedings of the Twenty–Fifth Asilomar Conference on Signals, Systems and Computers,* Nov. 4–6, 1991, pp. 785–789.

Griffin, D., et al, "Signal Estimation From Modified Short–Time Fourier Transform", *IEEE Transactions on Acoustics, Speech and Signal Processing,* vol. ASSP–32, No. 2, Apr. 1984, pp. 236–243.

Summerfield, C., et al, "ASIC Implementation of the Lyon Cochlea Model", *Proceedings of the 1992 International Conference on Acoustics, Speech and Signal Processing,* IEEE, vol. V, 1992, pp. 673–676.

Roucos, S., et al, "High Quality Time–Scale Modification for Speech", *Proceedings of the 1985 IEEE Conference on Acoustics, Speech and Signal Processing,* 1985, pp. 493–496.

R. Lyon, "A Computational Model of Binaural Localization and Separation", *Proceedings of IEEE International Conference on Acoustics, Speech and Signal Processing,* Apr. 1983, pp. 1148–1151.

Rabiner, L., et al., *Digital Processing of Speech Signals,* Prentice Hall, pp. 274–277.

Slaney M., et al, "On the Importance of Time—A Temporal Representation of Sound", *Visual Representation of Speech Signals,* edited by Martin Cooke, Steve Beet and Malcolm Crawford, 1993, John Wiley & Sons Ltd.

*Primary Examiner*—Allen R. MacDonald
*Assistant Examiner*—Richemond Dorvic
*Attorney, Agent, or Firm*—Burns, Doane, Swecker & Mathis

[57] ABSTRACT

A system for reconstructing a signal waveform from a correlogram is based upon the recognition that the information in each channel of the correlogram is equivalent to the magnitude of the Fourier transform of a signal. By estimating a signal on the basis of its Short-Time Fourier Transform Magnitude, each channel of information from a cochlear model can be reconstructed. Once this information is retrieved, a signal waveform can be resynthesized through inversion of the cochlear model. The process for reconstructing the cochlear model data can be optimized with the use of techniques for improving the initial estimate of the signal from the magnitude of its Fourier Transform, and by employing information that is known apriori about the signal during the estimation process, such as the characteristics of sound signals.

28 Claims, 8 Drawing Sheets

SOUND ANALYSIS AND RESYNTHESIS USING CORRELOGRAMS

FIELD OF INVENTION

The present invention is directed to the analysis and resynthesis of signals, such as speech or other sounds, and more particularly to a system for analyzing the component parts of a sound, modifying at least some of those component parts to effect a desired result, and resynthesizing the modified components into a signal that accomplishes the desired result. This signal can be converted into an audible sound or used as an input signal for further processing, such as automatic speech recognition.

BACKGROUND OF THE INVENTION

There exist a number of fields in which it is desirable to modify the characteristics of signal, particularly speech or other sound signals, in order to achieve a desired result. For example, in the coding of speech for transmission purposes, it is desirable to compress the speech to thereby reduce the amount of data that is to be transmitted. At the receiving end of the transmission, the compressed speech is expanded to reproduce the original sounds. The time scale modification of speech is also useful in the playback of recorded information. For example, a secretary who is transcribing recorded dictation may desire to speed up or slow down the playback rate, so that the words are reproduced at a rate that matches the typing speed. Of course, when the playback speed differs from the original recording speed, the pitch of the reproduced sound is altered, so that it does not sound natural. Consequently, it is desirable to modify the pitch of the recorded sound in conjunction with the time scale modification, so that the reproduction will sound more natural.

Another area in which the modification of sounds is useful is in sound-source separation. For example, when two people are speaking simultaneously, it is desirable to be able to separate the sounds from the two speakers and reproduce them individually. Similarly, when a person is speaking in a noisy environment, it is desirable to be able to separate the speaker's voice from the background noises.

In each of these areas, as well as others, the signal to be acted upon is first analyzed, to determine its component parts. Some of these component parts can then be modified, to produce a particular result, e.g. separation of the component parts into two groups to separate the voices of two speakers. Each group of component parts can then be separately resynthesized, to audibly reproduce the voices of the individual speakers or otherwise process them individually.

In the past, the analysis of sound, particularly speech, has been typically carried out with respect to the spectral content of the sound, i.e. its component frequencies. The various types of analysis which use this approach rely upon linear models of the human auditory system. In fact, however, the auditory system is nonlinear in nature. Of particular interest in this regard is the cochlea, i.e. that portion of the inner ear which transforms the pressure waves of a sound into electrical impulses, or neuron firings, that are transmitted to the brain. The cochlea essentially functions as a bank of filters, whose bandwidths change at different sound levels. Similarly, neurons change their sensitivity as they adapt to sound, and the inner hair cells produce nonlinear rectified versions of the sound. This ability of the ear to adapt to changes in sound makes it difficult to describe auditory perception in terms of linear concepts, such as the spectrum or Fourier transform of a sound.

Therefore, a different, and perhaps more useful, approach to the analysis of sound is from the standpoint of its temporal content. More particularly, an auditory signal has characteristic periodicity information that remains undisturbed by most nonlinear transformations. Even if the bandwidth, amplitude and phase characteristics of a signal are changing, its repetitive characteristics do not. Furthermore, sounds with the same periodicity typically come from the same source. Thus, the auditory system operates under the assumption that sound fragments with a consistent periodicity can be combined and assigned to a single source.

Along these lines, an analytical tool has been developed which provides a visual representation of the temporal content of a signal. This tool, which is called a correlogram, represents the signal as a three-dimensional function of time, frequency and periodicity. To generate a correlogram, a one-dimensional acoustic pressure is processed in a cochlear model. This model produces a two-dimensional map of neural firing rate as a function of time and distance along the basilar membrane of the cochlea. Then, by measuring the periodicities of the output signals from the cochlear model, a third dimension is added to produce the correlogram. The information contained in the correlogram can be used in a variety of ways. In addition to sound visualization, it can be used for pitch detection and modification, as well as sound separation. For further information regarding the correlogram and its applications, see Slaney et at, "On The Importance of Time—A Temporal Representation of Sound" published in *Visual Representation of Speech Signals,* edited by Martin Cooke, Steve Beet and Malcolm Crawford, 1993, John Wiley & Sons Ltd., the disclosure of which is incorporated herein by reference.

Heretofore, there has been no known technique for resynthesizing the information in a correlogram into a waveform that can be used to produce an audible sound or be otherwise processed. Part of the difficulty lies in the fact that, as a result of the signal processing that takes place to produce the correlogram, information regarding the phase content of the original signal is suppressed. Thus it is not possible to simply reverse the signal processing in order to reproduce the original sound. Rather, additional steps must be carried out to recover the suppressed phase information. This problem is further exacerbated if the correlogram is modified prior to resynthesis, since the modification may result in the loss of additional information.

Accordingly, it is the general objective of the present invention to provide a system and process for analyzing a signal, such as sound, with respect to its component features and reconstructing the signal from those features. Although not limited thereto, the present invention is particularly directed to a process which enables information in a correlogram to be inverted to produce a waveform that can be used to produce an audible sound or otherwise processed, for example in an automatic speech recognition system.

BRIEF STATEMENT OF THE INVENTION

In accordance with the foregoing objective, the present invention provides a signal resynthesis system which is based upon the recognition that each individual row, or channel, of the correlogram, which is a short-time autocorrelation function, is equivalent to the magnitude of the short-time Fourier transform of a signal. By estimating a signal on the basis of its Short-Time Fourier Transform Magnitude, each channel of information from the cochlear model can be reconstructed. Once this information is retrieved, a sound waveform can be resynthesized through approximate inversion of the cochlear filters, and can be used to generate an audible sound or otherwise be processed.

The process for reconstructing the cochlear model data can be optimized with the use of techniques for improving the initial estimate of the signal from the magnitude of its short-time Fourier transform, and by employing information that is known apriori about the signal during the estimation process.

This same approach to sound reconstruction is applicable to other types of sound analysis systems as well.

The foregoing features of the invention, as well as other aspects thereof, are explained in greater detail hereinafter with reference to a preferred embodiment that is illustrated in the accompanying drawings.

DETAILED DESCRIPTION

To facilitate an understanding of the present invention and its applications, it is described hereinafter with specific reference to its implementation in a speech analysis and modification system that employs a cochlear model and correlograms. It will be appreciated, however, that the practical applications of the invention are not limited to this particular embodiment.

Figure 1:
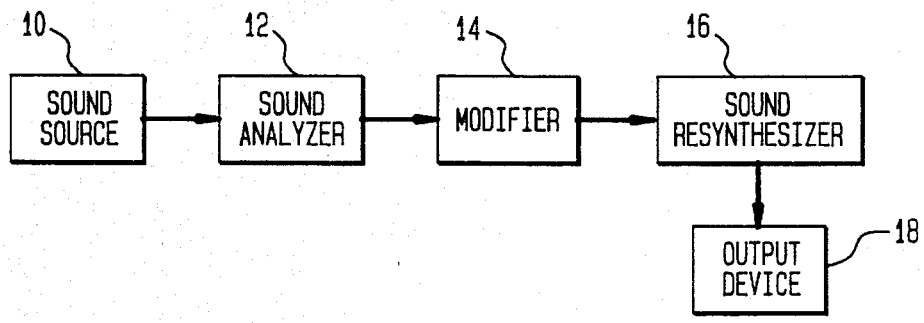
FIG. 1 is a general block diagram of a sound analysis and resynthesis system of a type in which the present invention can be employed.

A speech analysis system, of the type in which the present invention can be utilized, is illustrated in block diagram form in FIG. 1. Referring thereto, a speech signal from a source 10, such as a microphone or a recording, is provided to a sound analysis system 12. The sound analysis system produces a parametric representation of the original speech signal, which can then be modified to produce a desired result. For example, the parametric representation can be time-compressed for transmission purposes or faster playback, and/or the pitch can be altered. Alternatively, sound source separation can be carried out, to separate the voice of a speaker from a noisy background or the like. The particular form of modification that is carried out at the second stage 14 of the process will depend upon the result to be produced, and can be any suitable technique for modifying parametric signals to achieve a desired result. The details of the particular modification that is employed do not form a part of the invention, and therefore will not be described herein.

After the appropriate processing to achieve a desired result, the modified parametric representation undergoes a sound resynthesis process 16. This process is a pseudo-inverse of the original sound analysis, to produce a sound which is as close as possible to the original sound, with the desired modifications, e.g. the original speaker's voice without the background noise. The result of the sound resynthesis process is a waveform in the form of an electrical signal which can be applied to an output device 18 that is appropriate for any particular use of the waveform. For example, the output device could be a speaker to generate the modified sound, a recorder to store it for later use, a transmitter, a speech recognition device that converts the spoken words to text, or the like.

Figure 2:
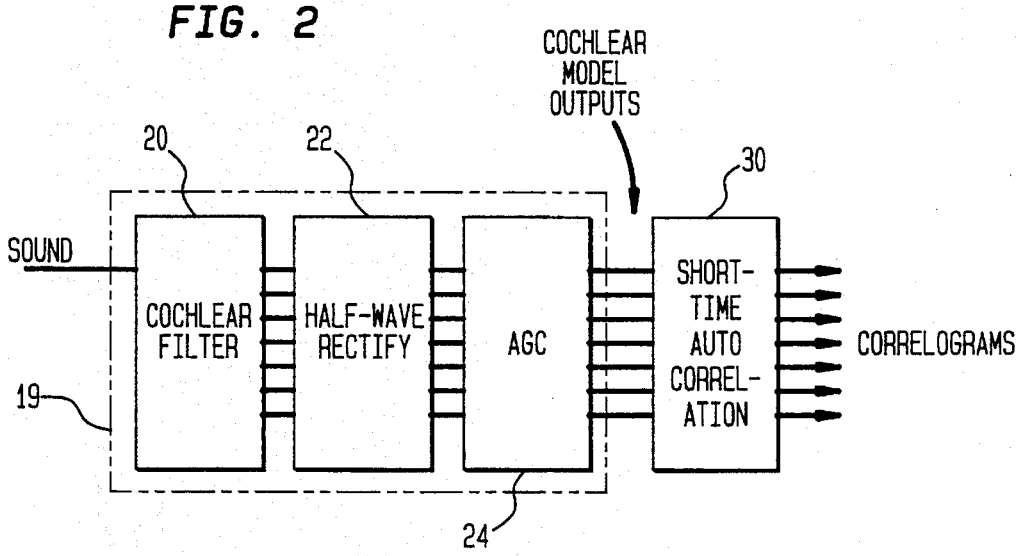
FIG. 2 is a more detailed block diagram of one embodiment of the sound analysis system.

A more detailed representation of the sound analysis system 12 is illustrated in block diagram form in FIG. 2. A portion of the sound analysis system comprises a model 19 of the cochlea in the inner ear. The cochlea converts pressure changes in the ear canal into neural firing rates that are transmitted through the auditory nerve. Sound pressure waves cause motion of the tympanic membrane which in turn transmits motion through the three ossicles (malleus, incus, and stapes) to the oval window of the cochlea. These vibrations are transmitted as motion of the basilar membrane in the cochlea. The membrane has decreasing stiffness from its base to its apex, which causes its mechanical response to change as a function of place. The net effect of this physiological arrangement is that the basilar membrane acts like a set of band-pass filters whose center frequencies vary with distance along the membrane. Accordingly, the first portion of the cochlear model 19 comprises a bank 20 of cascaded filters. The output signals from the early stages of the filter bank represent the response of the basilar membrane at the base of the cochlea, and subsequent stages produce outputs that are obtained closer to the apex. The center frequencies and bandwidths of the filters decrease approximately exponentially in a direction from base to apex. The output signal from each filter is referred to as a channel of information, and represents the signal at a point along the basilar membrane.

Within the cochlea, inner hair cells attached to the basilar membrane are stimulated by its movement, increasing the neural firing rate of the connected neurons. Since these hair cells respond best to motion in one direction, the signal for each channel is half-wave or otherwise nonlinearly rectified in a second stage 22 of the model.

Another characteristic of the cochlea is the fact that the sensitivity and the impulse responses of the membrane vary as a function of the sound level and its recent history. This feature is implemented in the cochlear model by means of an automatic gain control 24 that modifies the gain of each channel. As the level of the signal, e.g. its power, increases in a given frequency region, the gain is correspondingly reduced.

Figure 3:
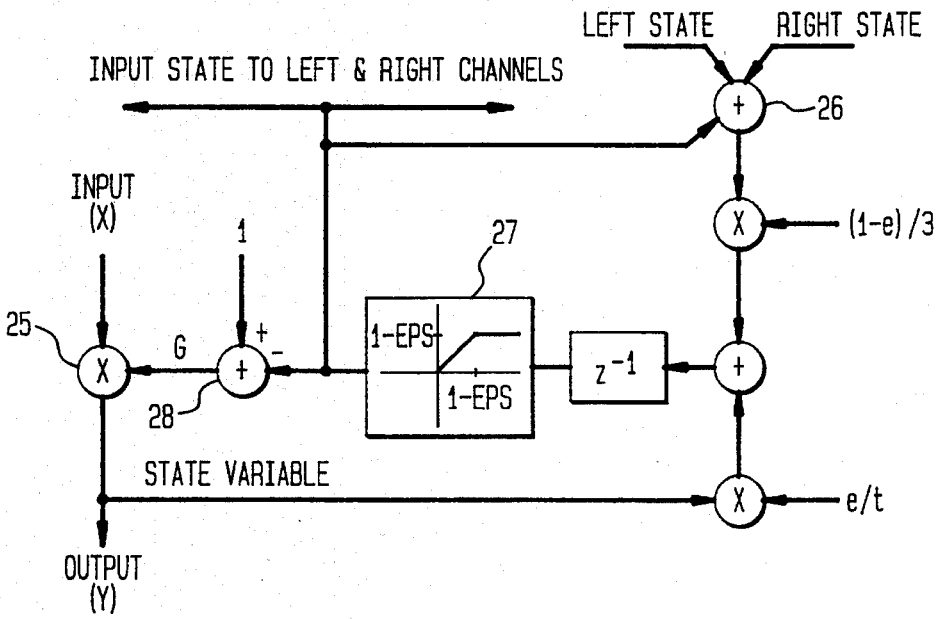
FIG. 3 is a schematic diagram of the automatic gain control circuit in one channel of the cochlear model.

A more detailed diagram of an automatic gain control circuit for one channel is shown in FIG. 3. Referring thereto, the half-wave rectified signal x from the filter is multiplied by a gain value G in a multiplier 25 to produce an output signal y. The circuit monitors the level of the output signal y to set the gain to an appropriate value that maintains the signal level within a suitable range. The AGC circuit 24 also functions to model the coupling that occurs between locations along the basilar membrane. To this end, the circuit receives inputs regarding the gain factor in the adjacent channels, at a summer 26. These inputs, together with the level of the signal y, are modified by two filter parameters, e and t, to generate a state variable. The parameter e represents the time constant for the filter, and t is a target value for the gain. To prevent instability, the state variable for the AGC filter can be limited to a maximum value of 1 in a limiting circuit 27. Furthermore, to insure that the gain is never zero, the state variable can be limited to a value which is less than one by a small amount epsilon (eps). The state variable is subtracted from the value unity in a summer 28, to determine the gain amount G which is multiplied with the input signal x. The state variable is also supplied to the adjacent left and fight channels to provide for the coupling between channels.

Preferably, the AGC circuit for each channel is made up of multiple AGC stages of the type shown in FIG. 3, e.g. four, which are cascaded together. Each of the filters has a different time constant e and output target value t, with the first filter in the series having the largest time constant (smallest e value) and largest target value.

Figure 4:
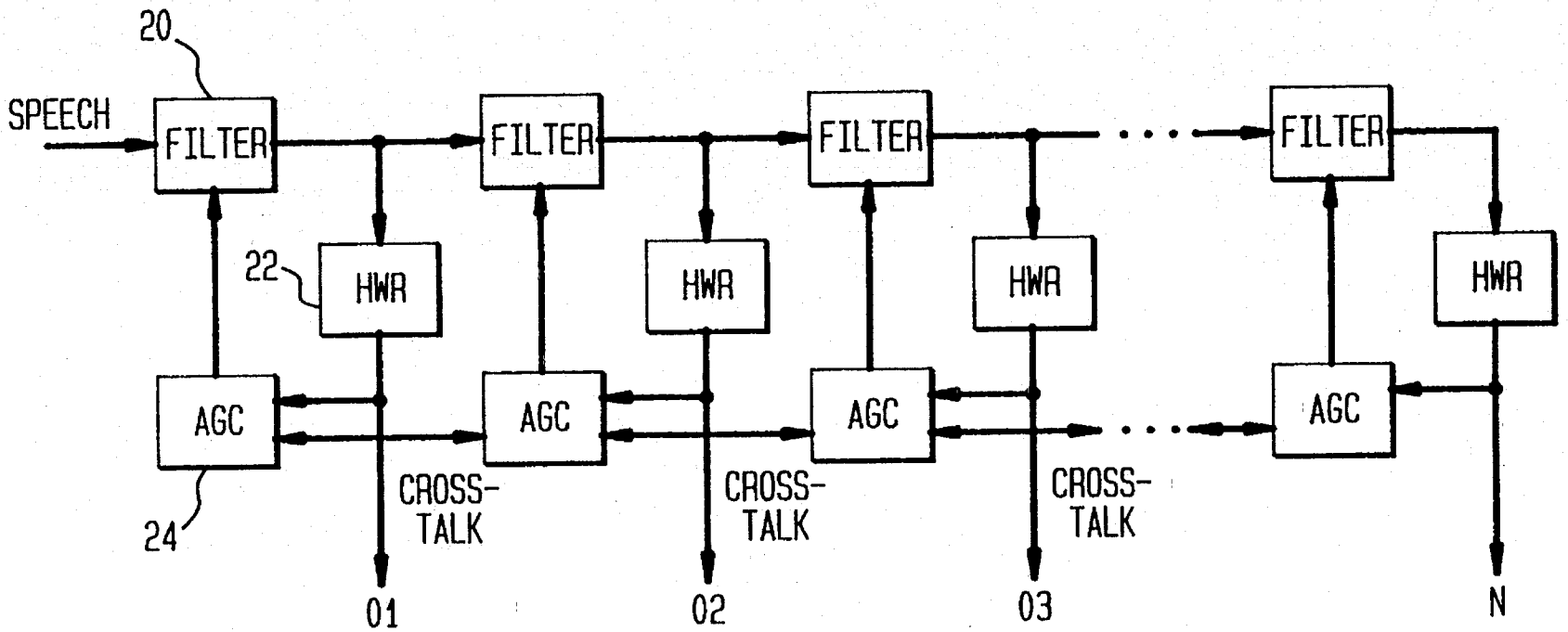
FIG. 4 is a detailed block diagram of another embodiment of the cochlear model.

An alternative embodiment of a cochlear model is shown in FIG. 4. In this embodiment, the AGC circuits 24 do not directly modify the level of the half-wave rectified signals from the filters 20. Rather, an adaptive AGC configuration is employed to modify the parameters of the filters themselves.

Figure 5:
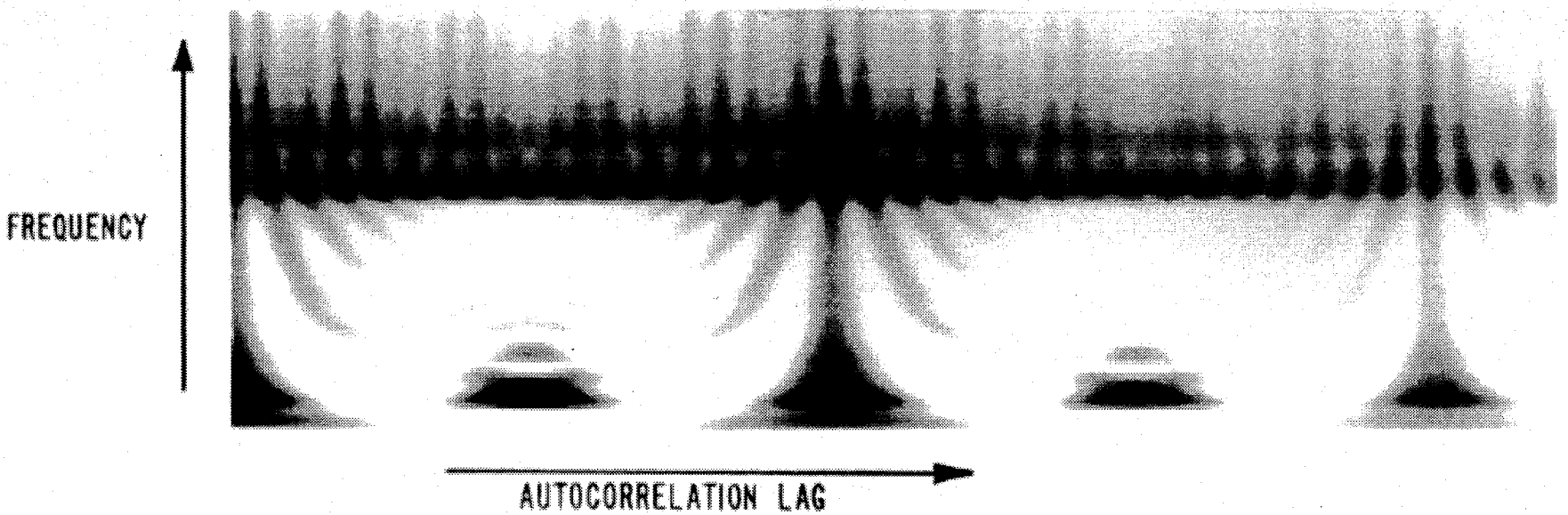
FIG. 5 is an example of one frame of a correlogram.

The output signals which are obtained from the cochlear model 19 provide a parametric representation of the input signal. This representation, which is referred to as a cochleagram, comprises a time-frequency representation, that can be used to analyze and display sound signals. A more useful representation of the original signal is provided, however, when its temporal structure is considered. To this end, the short-time autocorrelation of each channel in the cochleagram is measured in a subsequent stage 30 (FIG. 2), as a function of cochlear place, i.e. best frequency, versus time. The autocorrelation operation is a function of a third variable. Consequently, the resulting output data is a three-dimensional function of frequency, time and autocorrelation delay. All autocorrelations which end at the same time can be assembled into a frame of data. By displaying successive frames at a rate that is synchronized with the sound, a moving image of the sound can be provided. This moving image, or the data that it represents, is referred to as a correlogram. An example of one frame of a correlogram is shown in FIG. 5.

Figure 6:
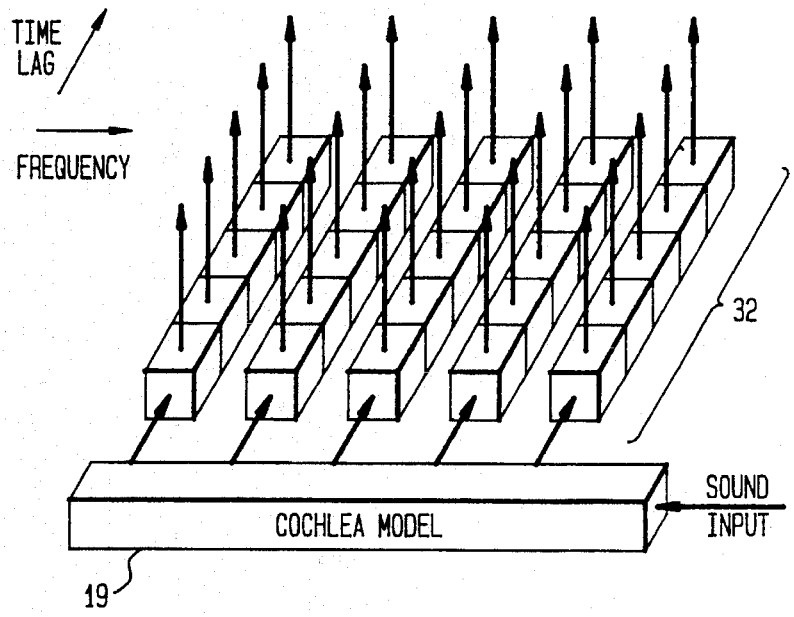
FIG. 6 is a pictorial representation of the structure for performing the short-time autocorrelation.
Figure 7:
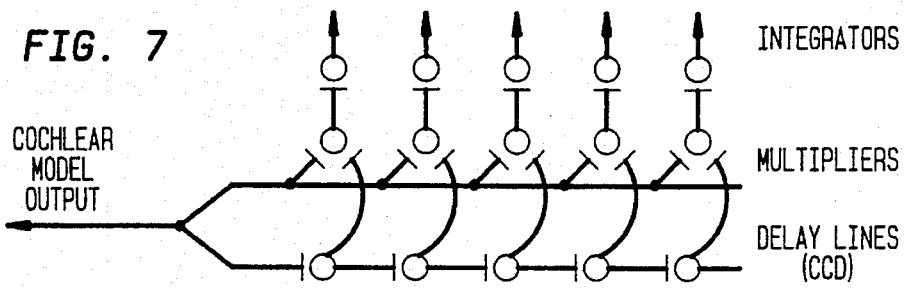
FIG. 7 is a more detailed schematic representation of the autocorrelation structure for one channel.

The short-time autocorrelator can be implemented by means of a group of tapped delay lines with multiplication, such as a CCD array. Referring to FIG. 6, each channel of data from the cochlear model 19 is fed to one row of a CCD array 32. Each stage of the array provides a delayed version of the input signal. The instantaneous value of the signal is compared with each of the delayed versions, for example by multiplying and integrating the signals as shown in FIG. 7. The pattern of autocorrelation versus delay time characterizes the periodicity of the original sound.

The circuits for the cochlear model and the autocorrelator can be implemented on a single chip. For further information regarding such an implementation, as well as a more detailed explanation of the individual circuits, see Lyon, "CCD Correlators for Auditory Models", *Proceedings of the Twenty-Fifth Asilomar Conference on Signals, Systems and Computers,* IEEE 785–789, Nov. 4–6, 1991, the disclosure of which is incorporated herein by reference.

As noted above, the correlogram is a useful tool for analyzing and processing speech signals. For example, if different portions of the correlogram represent signals that have different periodicity, these portions can be identified as emanating from different sources. These portions can then be separated from one another, to thereby separate the sound sources. Once the sound sources have been separated, their correlograms can be inverted to reproduce the waveforms that were used to produce them. These waveforms can then be processed as desired, or further inverted to resynthesize the original sounds. To resynthesize the sound, each channel of the correlogram must first be inverted to reconstruct the cochleagram. The reconstructed cochleagram must then be inverted to arrive at the original sound signal.

The inversion of the correlogram is based upon the recognition that the autocorrelation function is related to the square of the magnitude of the Fourier transform of a signal. Thus, the correlogram provides information pertaining to the magnitude of the Fourier transform of the signal that was autocorrelated.

To facilitate an understanding of the correlogram inversion process, a brief description of some of the principles relating to Fourier analysis is set forth herein. More complete analyses of these principles are contained in the publications that are referenced in the following description.

If x(n) denotes a real sequence, for example the samples of a sound waveform or a cochlear model channel output, its Short Time Fourier Transform (STFT) is given as $X_w(mS, \omega)$. The analysis window used to calculate the STFT, w(n), is defined to be real and non-zero for $0 \leqq n \leqq L-1$. Applying the window to the sequence creates a windowed portion of the sequence ending at a time index mS:

$$x_w(mS,n)=x(n)w(mS-n) \tag{1}$$

The variable S sets the amount of shift between windows and the index, m, is the window number. For each sequence of data so defined, the STFT is calculated to be $$X_W(mS,\omega) = \sum_{n=-\infty}^{\infty} x_W(mS,n)e^{-j\omega n} \tag{2}$$

The STFTs created from a signal are unique and consistent, so that given the STFTs at a sufficient number of window locations, the signal can be reconstructed exactly. However, an arbitrary set of STFTs might not correspond to a signal. A procedure has been developed to estimate the best signal $\hat{x}(n)$, given a set of STFTs, $Y_w(mS, \omega)$. See Griffin and Lim, "Signal Estimation From Modified Short-Time Fourier Transform," *IEEE Transactions on Acoustics, Speech and Signal Processing,* April 1984, pp. 236–243. This procedure can be employed in the practice of the present invention.

The signal estimation problem using a row of the correlogram, however, starts with the short-time auto-correlation function. The short-time auto-correlation function, $R_x(mS, \omega)$, can be calculated from the STFT, using the Fourier transform, and is written $$R_x(mS,n)=\frac{1}{2\pi}\int X_w(mS,\omega)X_w^*(mS,\omega)e^{jwn} \quad (3)$$

where * indicates complex conjugation. The short-time auto correlation function provides information about the magnitude of the STFT, but not the phase. The magnitude squared of the STFT is given by $$|Y_w(mS,\omega)|^2=\sum_{n=-\infty}^{\infty} R_x(mS,n)e^{-jwn} \quad (4)$$

Therefore, an approach using only the magnitude of the STFT, i.e., $|Y_w(mS,\omega)|$, must be employed to find the best estimate, $\hat{x}(n)$, of the original signal, x(n). An iterative procedure to arrive at the best estimate was developed by Griffin and Lim, and is described in the publication identified above.

In the application of that procedure to the present invention, the magnitude of the STFT, $|Y_w(mS,\omega)|$ is given, and an initial guess is made for the phase. One readily apparent guess is to assume zero phase, which leads to a maximally peaky signal that looks roughly speech-like. This initial STFT, $|Y_O(mS,\omega)|$, will not necessarily be a valid STFT, however. The following iterations can be carded out to improve the estimate.

A new estimate for the signal, $x_i(n)$, is calculated from $|Y_{i-1}(mS,\omega)|$ based on the following procedure known as overlap-and-add:

$$x_i(n)=\frac{\sum_{m=-\infty}^{\infty} y_{i-1}(mS,n)w(mS-n)}{\sum_{m=-\infty}^{\infty} w^2(mS-n)} \quad (5)$$

where the index i represents the number of iterations that have occurred and $y_{i-1}(mS,n)$ is the inverse Fourier transform of $Y_{i-1}(mS,\omega)$, which is equal to $y'_{i-1}(mS-n)$ where $y'_{i-1}$ has zero phase when the difference between mS and n is zero. At this point an estimate for the time-domain signal has been obtained. The phases of individual STFTs are forced to be consistent by adding the overlapping windows together.

The next step in the iteration procedure is to calculate the STFT of $x_i(n)$:

$$Y_i(mS,\omega)=\sum_{n=-\infty}^{\infty} x_i(n)e^{-jwn} \quad (6)$$

The phase of this new STFT is kept, the magnitude is replaced with the known value, $|Y_w(mS,\omega)|$, and this new modified STFT is used in the next iteration of the procedure.

This process of determining an estimated signal and finding its Fourier transform, substituting the known magnitude information into the transform, and calculating a new estimate can be repeated in an iterative manner until the results begin to converge to a best estimate $\hat{x}(n)$. The phase information for each STFT is calculated from the most recent estimate of the signal, while the magnitude is always set back to that which was originally supplied. This iterative procedure is illustrated in Steps 31 and 33 of the flow chart shown in FIG. 8.

In essence, therefore, the best estimate for the original signal x(n) is obtained by overlapping and adding the windowed time series obtained from the Short-Time Fourier Transform. Each window of information is obtained from the inverse Fourier transform of the STFT magnitude corresponding to the correlogram. Preferably, the length L of the window is restricted to be a multiple of four times the amount of window shift S. With this approach, computational requirements can be reduced because the denominator of the foregoing equation will be unity when a sinusoidal window as defined by the following is used:

$$w_s(n)=\frac{2w_r(n)}{\sqrt{4a^2+2b^2}}\left[a+b\cos\left(2\pi\frac{n}{L}+\phi\right)\right] \quad (7)$$

Figure 8:
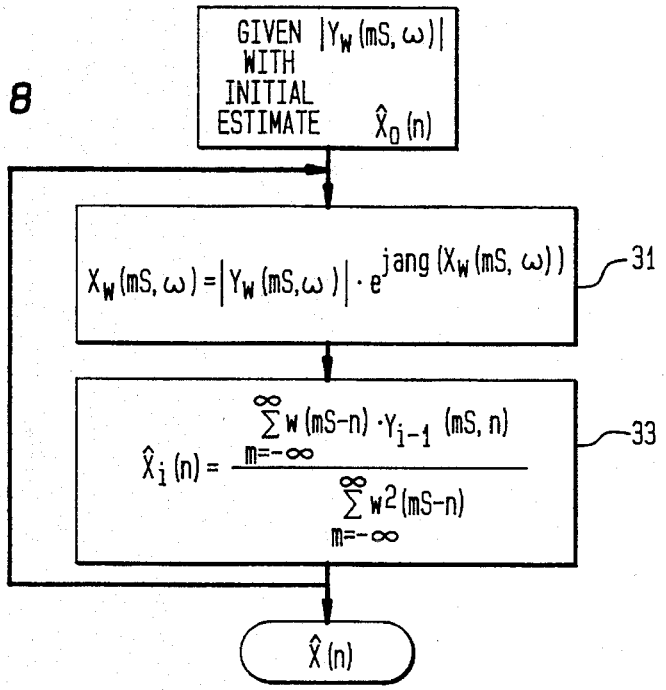
FIG. 8 is a flow chart of the iterative procedure for estimating a signal from its correlogram.

As successive iterations of the process illustrated in FIG. 8 are carried out, the results converge to a locally optimum solution $\hat{x}(n)$. The number of iterations that are required to develop this set of points will be largely dependent upon the accuracy of the initial estimate $\hat{x}_o(n)$. In the above-referenced publication by Griffin and Lim, they suggest that 25–100 iterations may be required. However, if the accuracy of the initial guess can be improved, the number of required iterations can be significantly reduced.

Figure 9:
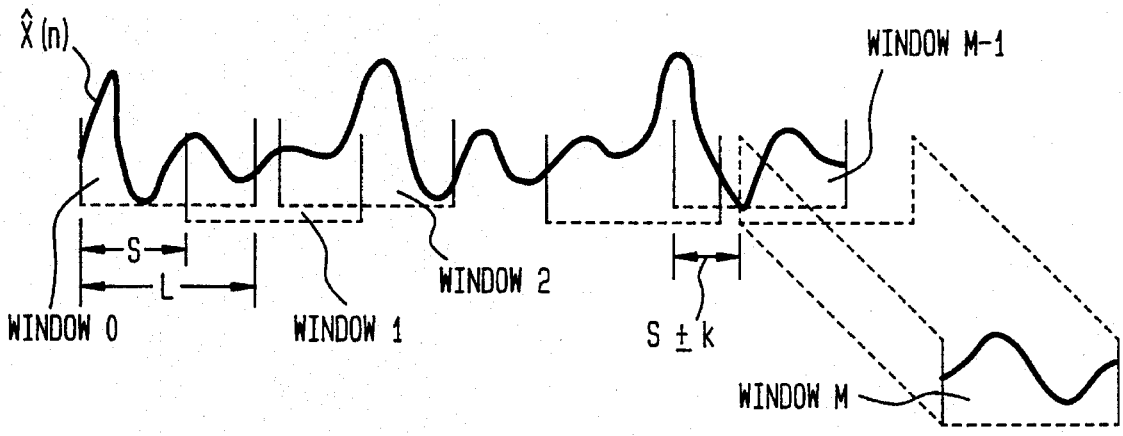
FIG. 9 is a signal diagram illustrating the overlap and add procedure.

A speech waveform is characterized by a large number of peaks and troughs. In a straightforward application of the overlap and add technique that is used to obtain the initial estimate of a speech signal, prior knowledge of the peaky nature of the signal provides a motivation to overlap each successive window of information on the series with zero phase shift. In other words, with reference to FIG. 9, when the information from window m is added to the series, it is placed at a location that is displaced from the information of the previous window by an amount equal to S. However, the accuracy of the initial estimate can be significantly increased if the relative locations of the window m and the previously developed data are shifted so that they are synchronized with one another. The amount of the shift is obtained by maximizing the cross-correlation of the information in window m with the remainder of the estimated signal up to window m−1. One procedure for determining the initial estimate in this manner is described in Roucos et at, "High Quality Time-Scale Modification for Speech," *Proceedings of the* 1985 *IEEE Conference on Acoustics, Speech and Signal Processing,* 1985, pp. 493–496, the disclosure of which is incorporated herein by reference.

To briefly illustrate the application of such a procedure to the present invention, let $\hat{x}^{(m)}(n)$ represent the state of the signal estimate after the first m windows of data have been overlapped and added. An initial value $\hat{x}^{(O)}(n)$ for the signal estimate is defined as follows:

$$\hat{x}^{(o)}(n)=w(n)y_w(O,n) \quad (8)$$

Thereafter, the information from the next window, $y_w(m,n)$, is shifted and added to the initial estimate. The amount of overlap is defined so that the cross-correlation of the original estimate and the newly added window of information is at a maximum. This cross-correlation, $R_{xy_w}$, is defined as follows:

$$R_{xy_w}(k)=\sum_{n=mS-k}^{mS-k+L} \hat{x}^{(m-1)}(n)\cdot y_w(mS,n+k) \quad (9)$$

The magnitude of the shift, k, is limited to one quarter of the window length. Once $k_{max}$(=k with the largest coefficient) is found, it is used to overlap and add the $m^{th}$ window in the following manner:

$$\hat{x}^{(m)}(n)=\hat{x}^{(m-1)}(n)+w(n)y_w(mS,n+k_{max}) \quad (10)$$

This process is repeated until all the windows have been added to the estimate, and $\hat{x}(n)$ is then divided by the denominator of Equation 5. The result of this process provides the initial estimate for the signal $x_O(n)$ in the procedure of FIG. 8.

In the frequency domain, this procedure is approximately equal to adding a linear phase to each window of data that is overlapped-and-added to form $x_O(n)$. To be perfectly proper, the shifts in Equations 9 and 10 should be circular but they are well approximated by a conventional linear shift.

The synchronized overlap-and-add procedure represented by Equations 9 and 10 essentially involves a process in which a window m of data is located at a position indicated by mS, and the phase of the underlying signal $\hat{x}^{(m-1)}(n)$ is shifted until a maximum correlation is obtained. Alternatively, it is possible to shift both the data and the window m by the amount k. In this alternative approach, the initial estimate $\hat{x}^{(O)}(n)$ is again defined as set forth in Equation 8, and the denominator of Equation 5 is defined as c(n), where $$c^{(o)}(n)=w^2(n) \tag{11}$$

Once the value for $k_{max}$ is found according to Equation 9, the $m^{th}$ window is added to the signal estimate in the following manner:

$$\hat{x}^{(m)}(n)=\hat{x}^{(m-1)}(n)+w(mS-k_{max}-n)y_w(mS,n+k_{max}) \tag{12}$$

In addition, the value for c(n) is updated as follows:

$$c^{(m)}(n)=c^{(m-1)}(n)+w^2(mS-k_{max}-n) \tag{13}$$

Once all of the windows have been added in this manner, the value for $\hat{x}(n)$ is then divided by c(n), to obtain $\hat{x}_o(n)$.

Figure 10:
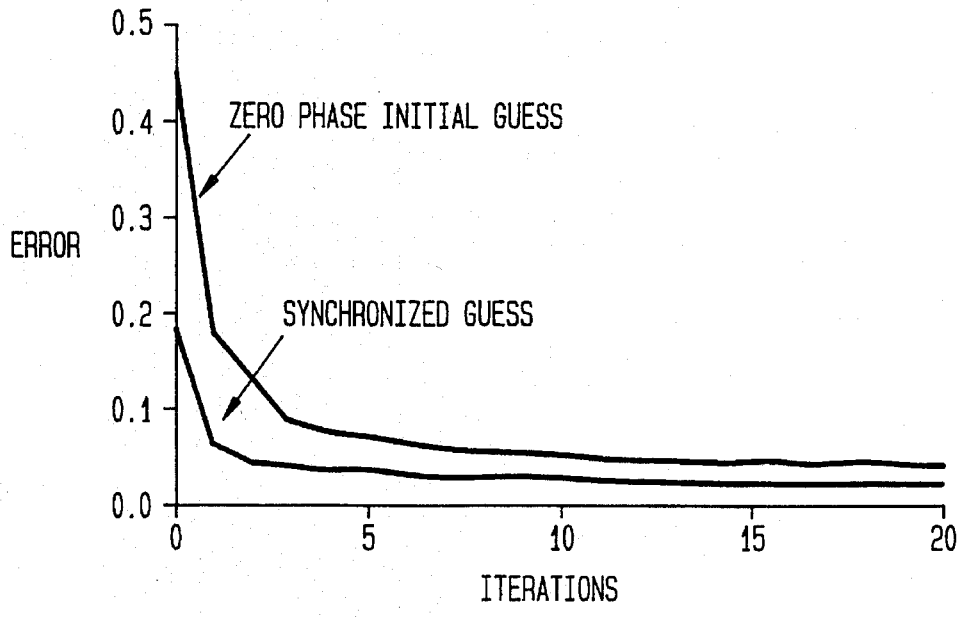
FIG. 10 is a chart comparing the results of signal estimations with and without synchronization.

It has been found that this approach, in which each window of information is synchronized with the previously developed signal, significantly improves the process of estimating a signal from a set of STFT magnitudes. FIG. 10 illustrates an example in which a 300 Hz sinusoidal signal, which is modulated at 60 Hz, is reconstructed from its STFT magnitudes, for the two cases in which the initial estimate is obtained with and without the synchronizing approach described above. As can be seen therefrom, the initial error is reduced by about half when the synchronized approach is employed. In addition, the error is smaller for the same number of iterations when the windows are synchronized. Thus, fewer iterations of the inversion process are needed, thereby reducing the required computational resources.

In fact, the initial estimate $\hat{x}(n)$ may be sufficiently accurate that no iterations of the procedure shown in FIG. 8 would be necessary. In a further simplification of the initial signal estimation process, the windowed correlograms can be directly employed, rather than transform them into the power spectrum domain, take the square root of the spectrum to obtain the magnitude, and then transform the result back to the time domain. This approach to the estimation of the signal from the autocorrelation function, although much simpler, is practical because the temporal structure of the original signal is preserved in the autocorrelation function, and the amplitude for a channel is also reflected in the amplitude of each autocorrelation function, in a squared form.

To further improve the correlogram inversion process, information that is known about the original signals can be employed to create a better estimate and further reduce the computational load. More particularly, it is known that the signals are half-wave rectified in the cochlear model. Accordingly, after each iteration of the overlap and add procedure, the signal estimate is preferably half-wave rectified.

It is also known that, prior to half-wave rectification, the signals in each channel of the correlogram are linearly delayed relative to one another by the stages of the cochlear filter. This information can be employed to predict the phase of successive channels after the first channel's signal is inverted by means of the overlap and add procedure.

If a channel is labelled as $\lambda_1$, its signal is identified as $x(\lambda_1,n)$. From the signal estimated for channel $\lambda_1$, a set of STFTs for that signal, i.e., $X_w(\lambda_1,mS,\omega)$, can be calculated using the procedures illustrated in FIGS. 8 and 9, and the phase information retained. The phase for each window of the next channel $\lambda_2$ is given by the phase of the $\lambda_1$ channel, or $$\angle\hat{X}_w(\lambda_2,mS,\omega) \approx \frac{X_w(\lambda_1,mS,\omega)}{|X_w(\lambda_1,mS,\omega)|} \tag{14}$$

where the operator $\angle$ represents phase as a unit magnitude complex vector. It is possible to employ this previously derived phase information for later channel calculations because the channels share a lot of information. With knowledge of the fact that the cochlear filter introduces a phase delay between channels, the anticipated phase change between channel $\lambda_1$ and $\lambda_2$ can also be included in the estimate. If the two channels are not adjacent, the phase change across the appropriate number of stages in the cochlear filter should be included. In this case, the estimated phase is changed to $$\angle\hat{X}_w(\lambda_2,mS,\omega) \equiv \angle\hat{X}_w(\lambda_1,mS,\omega)\cdot \frac{F_{\lambda 1+1}}{|F_{\lambda 1+1}|}\cdot\frac{F_{\lambda 1+2}}{|F_{\lambda 1+2}|}\cdots\frac{F_{\lambda 2}}{|F_{\lambda 2}|} \tag{15}$$

The STFTMs and their estimated phase functions are combined to create a set of estimated STFTs $$\hat{X}_w(\lambda_2,mS,\omega)=Y_w(\lambda_2,mS,\omega)\angle\hat{X}_w(\lambda_2,mS,\omega) \tag{16}$$

which are used to create the windows of data $$\hat{x}_w(\lambda_2,mS,n)=\frac{1}{2\pi}\int_{-\pi}^{\pi}\hat{X}_w(\lambda_2,mS,\omega)e^{j\omega n}d\omega \tag{17}$$

Finally, these sequences are combined in the synchronized overlap and add method to create the initial estimate of the signal for channel $\lambda_2$, $$\hat{x}_0(\lambda_2,n)=\frac{\sum_{m=-\infty}^{\infty} w(mS-n)\cdot\hat{x}_w(\lambda_2,mS,n)}{\sum_{m=-\infty}^{\infty} w^2(mS-n)} \tag{18}$$

which is used to initialize the correlogram inversion process described previously.

Figure 11:
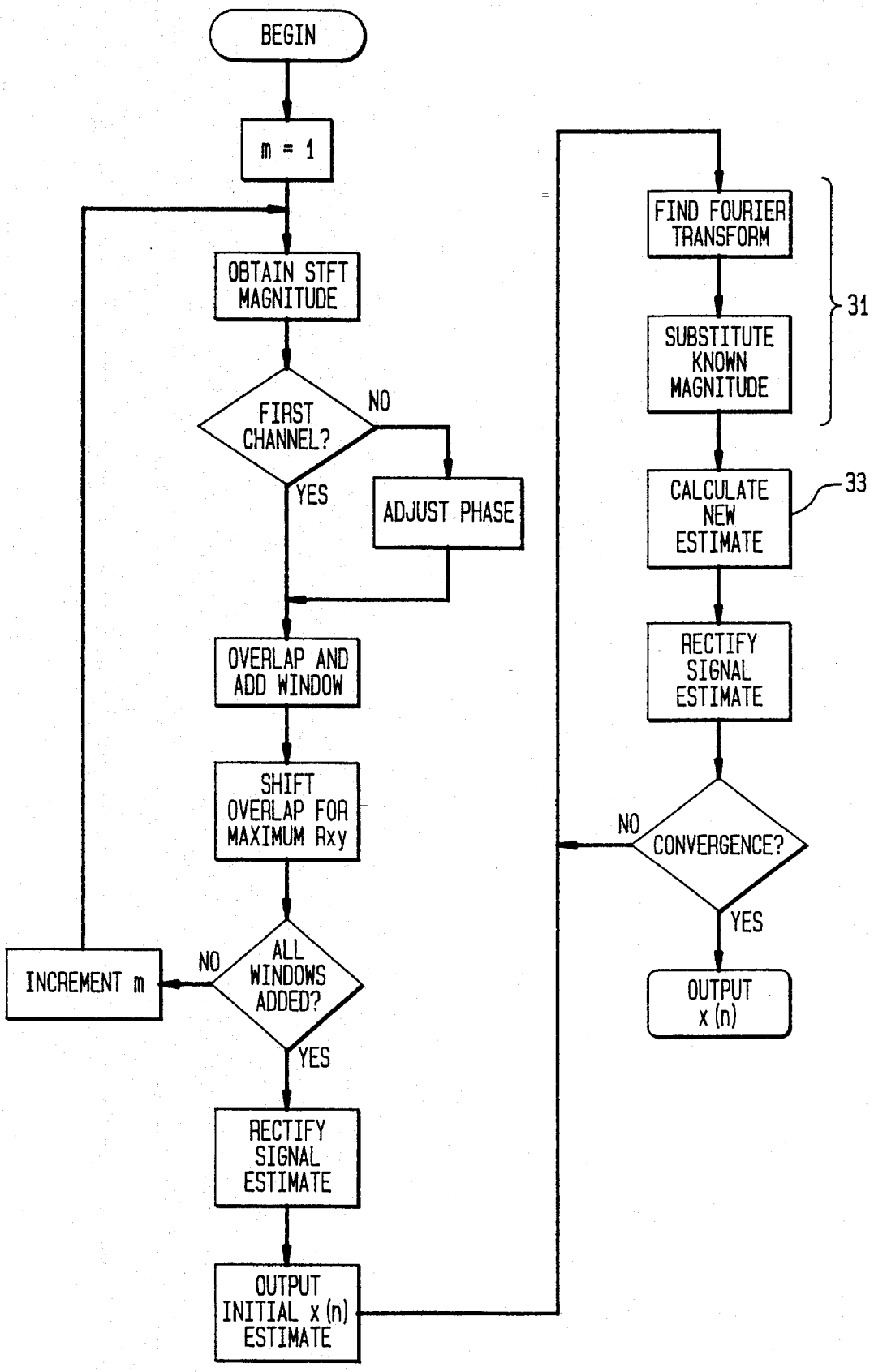
FIG. 11 is a flowchart of the correlogram inversion process.

The foregoing procedures invert the information in the correlogram to reconstruct a waveform corresponding to the cochleagram that was used to produce the correlogram. The process for inverting the correlogram can be carried out in a computer that is suitably programmed in accordance with the foregoing procedures and equations. The overall operation of the computer to carry out the process is summarized in the flowchart of FIG. 11. As shown therein Steps 31 and 33 are iteratively repeated until the signal estimates converge. Alternatively, it is possible to carry out a fixed number of iterations. The appropriate number of iterations to use can be empirically determined to assume reasonable convergence in most cases.

Of course, where the correlogram has been modified, the reconstructed cochleagram that is obtained with the foregoing procedure will be modified in a similar manner. For example, if the correlogram is modified to isolate the sounds from a particular source, the information in the reconstructed cochleagram will pertain only to the isolated sound.

The reconstructed waveform that is obtained through the correlogram inversion process can be directly applied to some utilization devices. More particularly, the waveform corresponding to the reconstructed cochleagram is a time-frequency representation of the original signal, which can be directly input to a speech recognition unit, for example, to convert the speech information into text. Alternatively, it may be desirable to further process the reconstructed cochleagram to resynthesize the original sound. To obtain the original (or modified) sound, the reconstructed cochleagram must be inverted. This inversion can involve three steps: AGC inversion, inversion of the half-wave rectification, and inversion of the cochlear filters.

Figure 12:
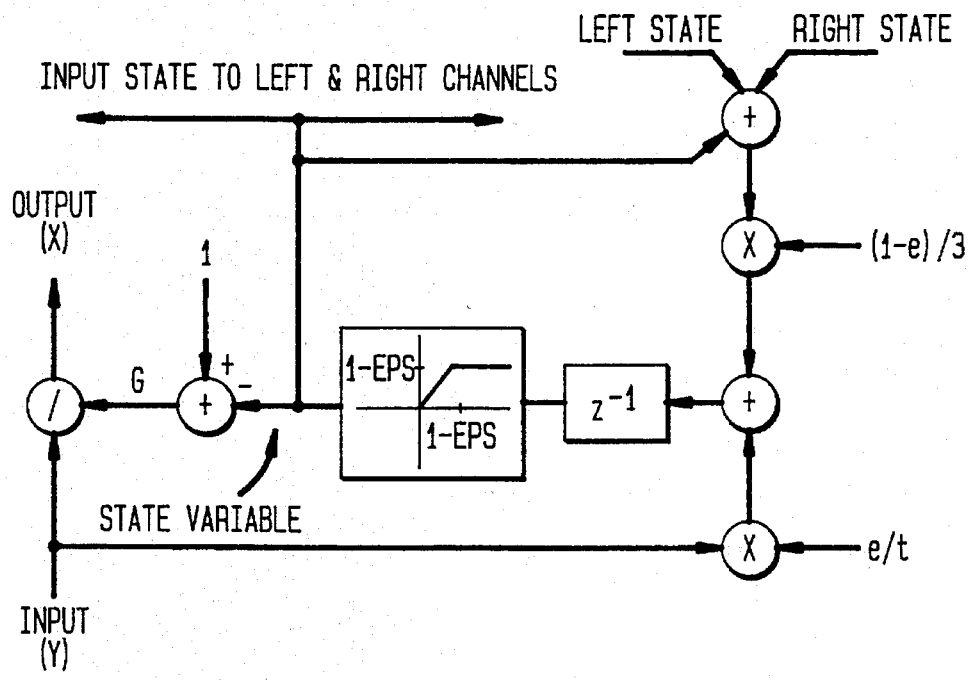
FIG. 12 is a schematic diagram of the AGC conversion circuit.

Each channel in the cochleagram is scaled by a time varying function calculated by the AGC filter. In order to invert this operation, it is necessary to determine the scaling function at each instant in time. Upon examination of the circuit of FIG. 3, it is evident that the loop gain is dependent only on the AGC output, which can be approximated from the inverted correlogram. Thus, by swapping the input and output points, and dividing instead of multiplying by the loop gain, the AGC is inverted. The restructured filter to perform the inversion is shown in FIG. 12. As can be seen, it is similar to the circuit of FIG. 3, except that the input signal y is divided by the gain value to produce an output signal x. If the AGC for each channel consists of multiple stages, the AGC inversion will also require multiple stages, in reverse order.

To prevent the AGC inversion process from becoming unstable, it may be necessary to limit the level of the input signal to the cochlear model. If the original input signal to the model is too large, the forward gain is small. During the inversion process, the input signal is divided by the small gain. If there are any errors in the reconstructed cochleagram, they become magnified and could create instability. However, by limiting the level of the input signal, this potential problem is avoided. The actual limit is best determined empirically, by performing inversion for signals with different amplitudes.

The inversion of the half-wave rectification is based upon the method of convex projections, given the known properties of the signal. It is known that the signals which form the cochleagram are half-wave rectified and band limited in the cochlear model. It has been previously shown that a band-limited signal and its half-wave rectified representation create closed convex sets, where a convex set is defined as a set in which, given any two points in the set, their midpoint is also a member of the set. See, for example, Yang et at., "Auditory Representations of Acoustic Signals," *IEEE Transactions on Information Theory,* Vol. 38, No. 2, March 1992, pp. 824–839, the disclosure of which is incorporated herein by reference. Thus, by applying the method of convex projections as described in the Yang et al. publication to the signals obtained from the circuit of FIG. 12, the half-wave rectification can be inverted.

Figure 13:
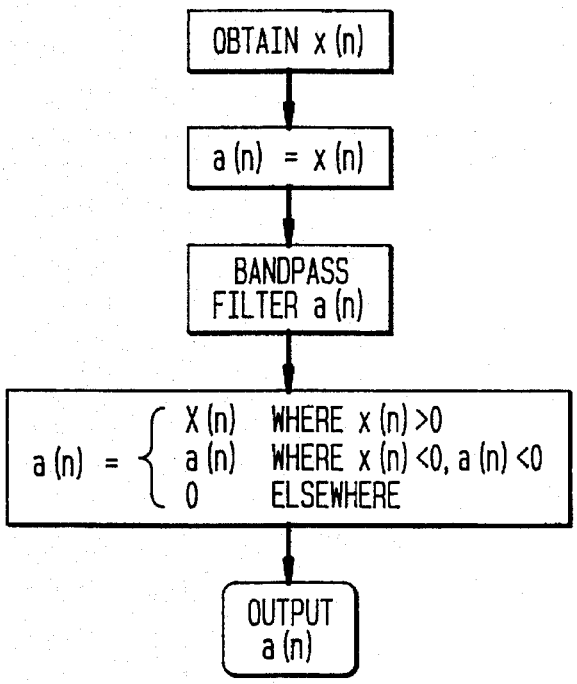
FIG. 13 is a flow chart of the process for inversion of the half-wave rectification of the filtered signal.

To illustrate, the positive values in the time domain of the originally filtered signals are known from the inverted correlogram, as well as the fact that these signals are band limited. By bandpass filtering each signal in the frequency domain, a new signal is formed which includes negative values. These negative values can be combined with the known positive values, and the resulting signal can again be bandpass filtered. By iterating between these two domains in this manner, the results converge to an approximation of the original signal from each channel of the cochlear model. This process is illustrated in the flowchart of FIG. 13, and can be implemented in a computer or in an analogous hardware circuit.

Figure 14:
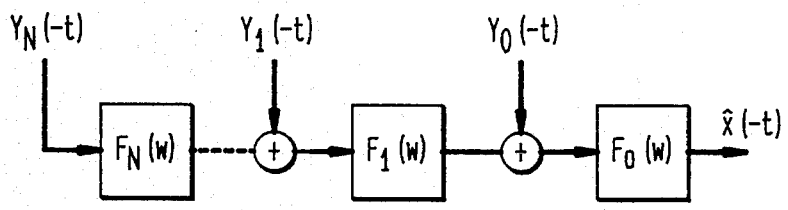
FIG. 14 is a block diagram of the inverse cochlear filter.

Finally, the inversion of the cochlear filter involves a reversal of the structure of the filter, coupled with a time reversal of both the output signal of each channel and the final result. The structure of the inverse cochlear filter is shown in FIG. 14. Note that the data $y_n$ from each channel of the cochleagram is fed into the structure at the appropriate point in a time-reversed manner, i.e., backwards. A spectral tilt correction can be applied to the time-reversed signal to adjust the gain of any frequencies where the combination of the forward and the inverse cochlear filters have a gain that is not equal to unity. Finally, the ultimate result is reversed to obtain the original waveform, which can then be applied to an appropriate output device, for example a speaker to produce the desired sound, a recorder, or the like.

Many of these disclosed steps are optional, depending upon the desired result and available resources. If the AGC inversion is not performed, for example, some computational effort is saved and the output will be compressed in a perceptually relevant manner. The cochlear filter is basically a bank of bandpass filters, and therefore the HWR inversion stage can be left out with the same function being performed by the cochlear filter bank. Finally, there are many ways to implement the spectral tilt correction, or it can be left out completely.

Figure 15:
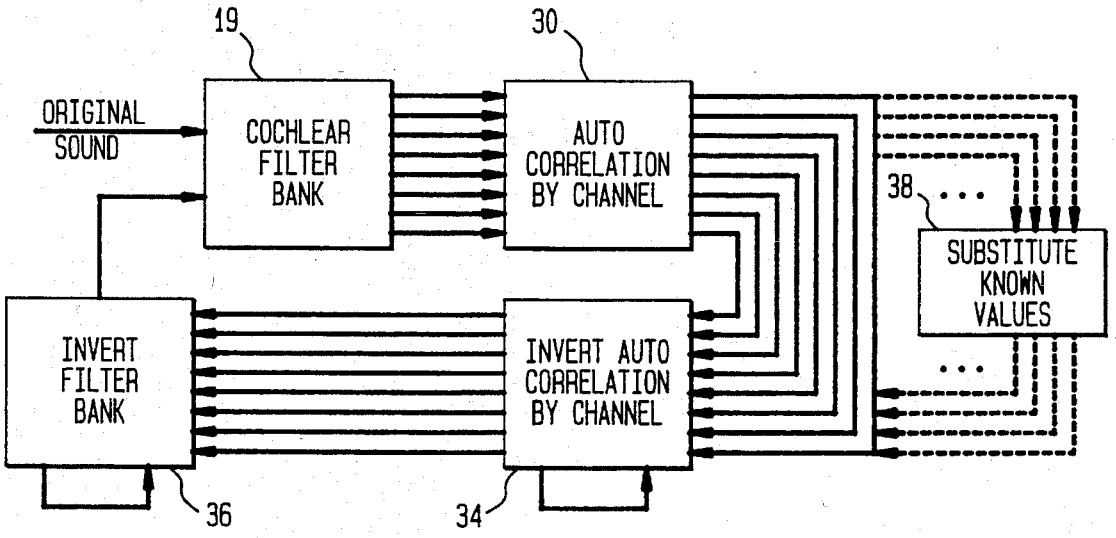
FIG. 15 is a block diagram of a closed-loop implementation of the sound analysis and resynthesis system.

In some cases it may be desirable to refine the resynthesized sound waveform through a closed-loop process. For example, when the waveform is reconstructed from a partial correlogram, multiple iterations of the analysis and resynthesis process may provide improved results. Such a closed-loop approach is diagrammatically illustrated in FIG. 15. Referring thereto, the correlogram data is inverted in a stage 34 according to the procedure of FIG. 11, to reconstruct a cochleagram. Thereafter, the sound waveform is reconstructed by inverting the cochlear model in a stage 36, as described previously.

The reconstructed waveform can then be analyzed in the cochlear model 19 and the auto-correlator 30, to produce a new correlogram. During the second and subsequent passes through the analysis and resynthesis procedure, the values in the new correlogram are replaced with the values that are known from the original partial correlogram, in a stage 38. This modified correlogram is inverted in stages 34 and 36 to produce a more refined waveform. The iterations around the loop can be repeated as many times as desired to produce an acceptable waveform.

From the foregoing, it can be seen that the present invention enables sounds to be analyzed and resynthesized with the use of an overlap-and-add procedure, and is particularly applicable to sounds that have been analyzed in the form of correlograms. Since the correlogram provides temporal information in addition to spectral information, it offers greater capabilities in sound separation and other forms of speech modification.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

We claim:

1. A method for generating a waveform which is a modified representation of an original sound, comprising the steps of:

filtering the original sound through a plurality of filters to produce a cochleagram containing multiple channels of data each representative of a portion of a frequency range of the original sound;

autocorrelating each channel of data in the cochleagram to produce a correlogram;

modifying the correlogram in accordance with a desired modification of the original sound; and inverting at least one channel of the modified correlogram to generate a first waveform representative of a modified sound.

2. The method of claim 1 wherein said filtering step includes passing the original sound through a cascaded series of filters, wherein an output signal from each filter comprises one channel of data in said cochleagram.

3. The method of claim 1 wherein said filtering step includes the further step of non-linearly rectifying an output signal of each filter.

4. The method of claim 1 wherein said filtering step includes the further step of multiplying an output signal of each filter by a gain factor determined in accordance with the magnitude of the output signal.

5. The method of claim 1 further including the step of processing said first waveform by an inverse of said filtering step to generate a second waveform.

6. The method of claim 5 wherein the first waveform comprises a modified cochleagram and the step of processing the first waveform includes the step of dividing each channel of data in said modified cochleagram by a gain factor.

7. The method of claim 5 wherein the first waveform comprises a modified cochleagram and the step of processing the first waveform includes the steps of respectively feeding data from each channel of the modified cochleagram into a plurality of filters in a time-reversed manner, and reversing the output signal from the filters.

8. The method of claim 1 wherein the step of inverting a channel of the modified correlogram includes the steps of:

i) determining a Fourier Transform (Y) of one channel of data across all time frames of the modified correlogram;

ii) estimating a signal $x_i$ that corresponds to said Transform Y;

iii) obtaining a Fourier Transform $X_i$ of said estimated signal $x_i$;

iv) replacing the magnitude of the Transform $X_i$ with the magnitude of the Transform Y to obtain a new Transform $X_{i+1}$; and v) determining a new estimated signal $x_{i+1}$ for the new Transform $X_{i+1}$.

9. The method of claim 8 further including the step of vi) iteratively repeating steps iii) through v) with respect to the new Transform $X_{i+1}$.

10. The method of claim 9 further including the step of vii) repeating steps i) through vi) for each of the other channels of data.

11. The method of claim 8 wherein the step of estimating the signal that corresponds to the Transform Y includes the steps of overlapping and adding successive windows of data obtained from the Transform Y.

12. The method of claim 11 further including the step of adjusting each added window of data, relative to the estimated signal, to obtain a maximum cross-correlation between the window of data and the estimated signal.

13. The method of claim 11 further including the step of modifying the signal estimate to conform with information that is known about said cochleagram data.

14. The method of claim 13 wherein said modification includes the step of half-wave rectifying the signal estimate.

15. The method of claim 13 wherein said modification includes determining a phase for an initial estimate of a channel's signal on the basis of the phase of a signal that was previously determined for another channel.

16. The method of claim 15 wherein the phase for the initial estimate of a channel's signal is shifted, relative to the phase of said other channel's signal, by an amount related to phase delays introduced during said filtering step.

17. The method of claim 1 wherein the step of inverting a channel of the modified correlogram includes the steps of:

i) determining a Fourier transform of one channel of data for successive time frames of the modified correlogram, ii) overlapping and adding successive windows of data obtained from the Fourier transform to obtain successive signal estimates, and iii) adjusting each added window of data, relative to the estimated signal, to obtain a maximum cross-correlation between the added window of data and the estimated signal.

18. A system for analyzing and resynthesizing a sound, comprising:

a cochlear model which produces a parametric representation of a sound;

an autocorrelator for processing said parametric representation to provide data regarding periodicity of the sound;

means for generating an estimated signal from a Fourier Transform of said data; and means for processing said estimated signal in an inverse manner from said cochlear model to produce a resynthesized sound waveform.

19. The system of claim 18 further including means for modifying the data from said autocorrelator to thereby modify the resynthesized sound.

20. The system of claim 18 wherein said signal estimating means overlaps successive windows of data obtained from a Fourier transform to form an estimated signal, and adjusts each added window, relative to the estimated signal, to obtain a maximum cross-correlation between the added window of data and the estimated signal.

21. A method for resynthesizing a sound from a correlogram that is representative of the sound, comprising the steps of:

obtaining a Fourier transform of at least one channel of the correlogram;

estimating a signal for said channel of the correlogram from its Fourier transform; and processing the estimated signal through an inverted cochlear model to produce a synthesized sound waveform.

22. The method of claim 21 further including the step of generating an audible sound from the synthesized sound waveform.

23. The method of claim 21 wherein the step of estimating a signal includes the process of overlapping and adding windows of data obtained from the Fourier transform of the channel of the correlogram.

24. The method of claim 23, further including the step of adjusting each added window of data, relative to the estimated signal, to obtain a maximum cross-correlation between the window of data and the estimated signal.

25. The method of claim 23 further including the step of non-linearly rectifying the estimated signal.

26. A method for resynthesizing a sound waveform from sequence of short-time auto-correlation functions, comprising the steps of:

obtaining Fourier transforms of the auto-correlation functions;

overlapping and adding successive windows of data obtained from the Fourier transforms to obtain successive signal estimates; and adjusting each added window of data, relative to the signal estimate obtained from the previously added windows of data, to provide a maximum cross-correlation between the window of data and the signal estimate, to thereby generate a resynthesized waveform representative of a sound.

27. The method of claim 26 further including the steps of;

determining a sequence of Fourier transforms of the resynthesized waveform;

replacing the magnitude of the determined Fourier transforms with the magnitudes of the Fourier transforms that were originally obtained from the sequences of auto-correlation functions; and obtaining a new resynthesized waveform from the determined Fourier transforms whose magnitudes were replaced.

28. The method of claim 27 wherein the steps of determining the Fourier transforms, replacing the magnitudes and obtaining a new resynthesized waveform are iteratively repeated.

* * * * *